US005857521A

United States Patent [19]

Ross et al.

[11] Patent Number: 5,857,521

[45] Date of Patent: Jan. 12, 1999

[54] METHOD OF USING A RETRIEVABLE SCREEN APPARATUS

[75] Inventors: Colby M. Ross, Carrollton; Ralph H. Echols, Dallas; Jim Venditto, Sugar Land, all of Tex.

[73] Assignee: Halliburton Energy Services, Inc., Dallas, Tex.

[21] Appl. No.: 927,924

[22] Filed: Sep. 11, 1997

Related U.S. Application Data

[62] Division of Ser. No. 642,037, Apr. 29, 1996, Pat. No. 5,762,137.

[51] Int. Cl.[6] ..... E21B 43/08; E21B 43/12

[52] U.S. Cl. ..... 166/296; 166/236; 166/376; 166/380; 166/387

[58] Field of Search ..... 166/205, 228, 166/236, 265, 296, 376, 377, 380, 386, 387

[56] References Cited

U.S. PATENT DOCUMENTS

| | | | |
|---|---|---|---|
| 3,842,912 | 10/1974 | Lindsey, Jr. | 166/307 |
| 4,495,073 | 1/1985 | Beimgraben | 210/448 |
| 5,004,049 | 4/1991 | Arterbury | 166/228 |
| 5,190,102 | 3/1993 | Arterbury et al. | 166/228 |
| 5,293,935 | 3/1994 | Arterbury et al. | 166/228 |
| 5,295,538 | 3/1994 | Restarick | 166/205 |
| 5,310,000 | 5/1994 | Arterbury et al. | 166/296 |
| 5,377,750 | 1/1995 | Arterbury et al. | 166/205 |
| 5,579,844 | 12/1996 | Rebardi et al. | 166/296 |
| 5,611,399 | 3/1997 | Richard et al. | 166/230 |
| 5,730,223 | 3/1998 | Restarick | 166/380 |

OTHER PUBLICATIONS

"High Pressure Filtration Units" Otis Engineering Corporation Sand Control catalog; 1991; p. 17.

Porous Metal Filter Elements Newmet Krebsoge catalog; Mar., 1995; pp. 1–11.

Design and Application of Sintered Porous Stainless Steel Well Screens in Sand Control Completions SPE 23770; R.C. Cole, Halliburton Services, Alan Arterbury, Howard Smith Screen Co., and Bud Pearce, Otis Engineering Corporation; Feb., 1992.

*Primary Examiner*—George Suchfield
*Attorney, Agent, or Firm*—Paul I. Herman; Marlin R. Smith

[57] ABSTRACT

A retrievable screen apparatus provides increased filtration in a retrievable screen disposed within a receptacle, the receptacle being positioned in a subterranean well. The receptacle has a lower filtration screen attached thereto for filtering larger particles, such as gravel and proppant, from fluid flow within the well. Thus, the retrievable screen may be retrieved and replaced, leaving the receptacle operatively positioned in the well.

9 Claims, 7 Drawing Sheets

METHOD OF USING A RETRIEVABLE SCREEN APPARATUS

This is a division of application Ser. No. 08/642,037 filed Apr. 29, 1996 now U.S. Pat. No. 5,762,137.

BACKGROUND OF THE INVENTION

The present invention relates generally to equipment for use in subterranean wells and, in a preferred embodiment thereof, more particularly provides a retrievable screen apparatus and methods of using the apparatus.

Sand control screens are utilized for various purposes in subterranean wells. The name derives from their early use in preventing the production of sand along with fluids from formations. A sand control screen is typically suspended from production tubing extending to the earth's surface and positioned in a wellbore opposite a productive formation. In this way, the sand control screen may exclude the produced sand while permitting the valuable fluids to enter the tubing for transport to the earth's surface.

Other operations in which sand control screens are utilized include fracturing and gravel packing. In fracturing and gravel packing operations, material known as "proppant" or "gravel" is usually suspended in a slurry and pumped down the tubing and into the annular space between the sand control screen and metal casing lining the wellbore. The material typically accumulates in the annular space and eventually fills it, completely covering the exterior surface of the screen. The sand control screen prevents this material from being pumped back to the earth's surface.

Since it is generally not possible to pump gravel or proppant through the screen, other flow passages are typically provided in a fracturing and/or gravel packing apparatus to permit fluid communication between the tubing and the annular space. These other flow passages must then be closed when it is desired to produce fluids from the formation, which usually requires mechanical or pressure-operated devices, or manipulation of the tubing.

In some situations, it is necessary to filter very fine particles from the produced formation fluids. High filtration screens are used in these situations. Unfortunately, such high filtration screens usually become clogged with debris relatively quickly. Therefore, it is advantageous for high filtration screens to be retrievable, so that they may be periodically retrieved and either replaced, or cleaned and reinstalled. In addition, it would be desirable for a high filtration screen to have a low filtration screen disposed between the high filtration screen and the annular space, so that the high filtration screen would not become clogged as quickly, and so that the low filtration screen will prevent production of large sand particles or other debris when the high filtration screen is retrieved for cleaning or replacement.

It is well known in the art for a screen to be retrievably attached to, and suspended from, production tubing. Such screens provide a means of retrieval and replacement of the screens adjacent a productive formation. They do not, however, permit fracturing or gravel packing operations therethrough since an open end of the tubing is exposed when the screen is not in place. They also have no provision for placement of a low filtration screen between a high filtration screen and the produced formation.

From the foregoing, it can be seen that it would be quite desirable to provide a retrievable screen which may be installed in tubing or attached to a packer, which may have a low filtration portion between a high filtration portion and a producing formation, and which may be utilized in association with other operations, such as fracturing and gravel packing operations. It is accordingly an object of the present invention to provide such a retrievable screen apparatus and methods of using the apparatus.

SUMMARY OF THE INVENTION

In carrying out the principles of the present invention, in accordance with an embodiment thereof, a retrievable screen apparatus is provided which has an inner tubular screen received in a receptacle which may have an outer tubular screen attached thereto. The retrievable screen apparatus permits retrieval and replacement of the inner screen without removing the receptacle from a well. Methods are also disclosed for using the retrievable screen apparatus.

The receptacle is tubular and has openings formed radially therethrough for fluid communication between a formation intersected by the well and tubing extending to the earth's surface. In one embodiment of the present invention, a tubular outer screen is sealingly attached to the receptacle radially outwardly covering the openings so that the outer screen filters fluid flowing through the openings.

The receptacle also has two seal bores, the seal bores axially straddling the openings. When the inner screen is operatively positioned within the receptacle, seals axially straddling the inner screen sealingly engage the seal bores, thus preventing leakage of fluid axially between the inner and outer screens.

The receptacle and inner screen are releasably latched together utilizing collets attached to the inner screen. The collets engage a complementarily shaped recess formed internally on the receptacle. A release sleeve may be utilized to radially outwardly maintain the collets engaged in the recess, until it is desired to release the collets so that the inner screen may be retrieved.

The inner screen also has a retrieval portion attached thereto. When it is desired to retrieve the inner screen, a device, such as a threaded device or fishing tool, is engaged with the retrieval portion and the inner screen is withdrawn to the earth's surface through the tubing.

The use of the disclosed retrievable screen apparatus enables greater fluid filtration in production, gravel packing, fracturing, injection, and other operations. In one embodiment, the retrievable inner screen has higher filtration than the outer screen, enabling the higher filtration screen, which is more likely to become clogged with debris, to be conveniently removed from the well, cleaned or replaced, and reinstalled in the receptacle.

The features listed above are among those provided by the disclosed preferred embodiment of the present invention. Other features will become apparent upon consideration of the detailed description set forth hereinbelow. It will be readily appreciated by one of ordinary skill in the art that these features may be utilized individually or in any combination in a retrievable screen apparatus and methods of using same embodying principles of the present invention.

DETAILED DESCRIPTION

Figure 1A:
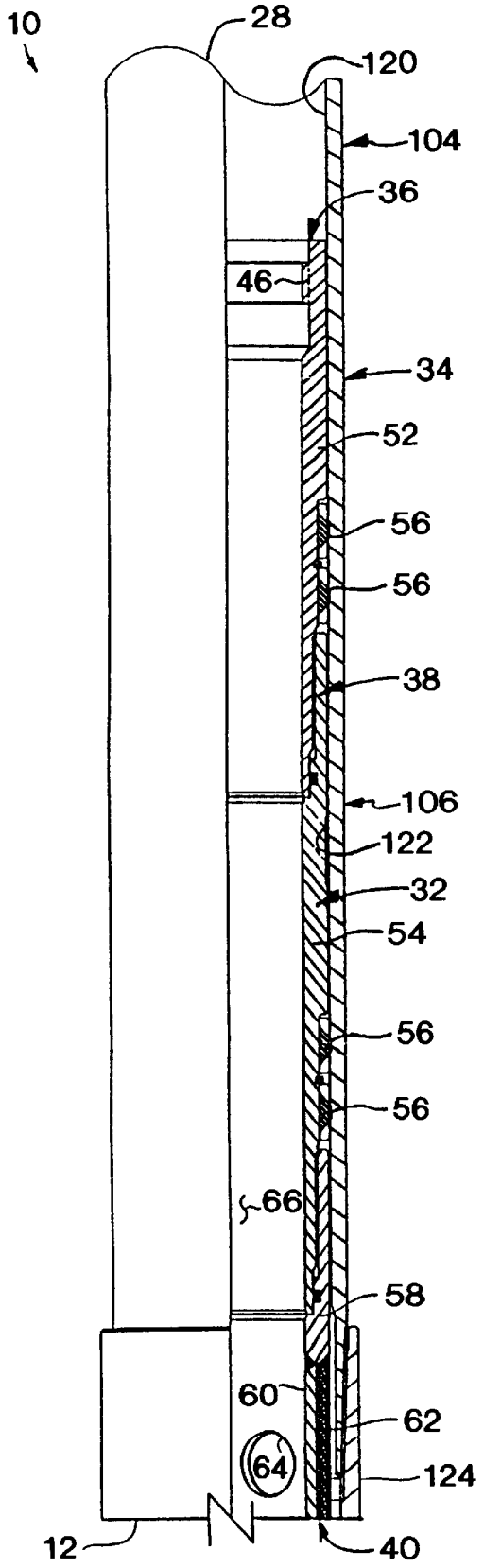
FIGS. 1A–1E are quarter-sectional views of successive axial portions of a retrievable screen apparatus embodying principles of the present invention.

Representatively illustrated in FIGS. 1A–1E is a retrievable screen apparatus 10 embodying principles of the present invention. In the following detailed description of the embodiments of the present invention representatively illustrated in the accompanying figures, directional terms such as "upper", "lower", "upward", "downward", etc. are used in relation to the illustrated retrievable screen apparatus 10 as it is depicted in the accompanying figures. It is to be understood that the retrievable screen apparatus 10 may be utilized in vertical, horizontal, inverted, or inclined orientations without deviating from the principles of the present invention.

FIGS. 1A–1E show successive axial portions of the retrievable screen apparatus 10, comprising a continuous assembly. Thus, lower ends 12, 16, 20, and 24 are continuous with upper ends 14, 18, 22, and 26, respectively. For running into a well, upper end 28 may be configured for attachment to production tubing, a packer, a tubing release apparatus, or other equipment, by forming internal or external threads thereon, forming a latching profile thereon, or other methods. Lower end 30 may be closed or capped off, or it may also be configured for attachment to other equipment by forming threads thereon, providing seals, etc.

As representatively illustrated in FIGS. 1A–1E, the retrievable screen apparatus 10 includes an inner screen assembly 32 and an outer receptacle 34. In combination, the inner screen assembly 32 and outer receptacle 34 provide features heretofore unobtainable in retrievable screen designs.

The inner screen assembly 32 includes a retrieval portion 36, an upper seal portion 38, a screen portion 40, a lower seal portion 42, and a latch portion 44. Although the foregoing portions of the inner screen assembly 32 are representatively illustrated as being successive axial portions, it will be readily apparent to one of ordinary skill in the art that certain ones of the portions may be interchanged or combined. For example, the latch portion 44 may easily be combined with the retrieval portion 36.

The retrieval portion 36 is generally tubular shaped and is preferably disposed on an upper part of the inner screen assembly 32 for ease of access. As shown in FIG. 1A, the retrieval portion 36 has threads 46 internally formed thereon. As will be described in further detail hereinbelow, the threads 46 permit attachment of a pulling tool 48 (see FIG. 4) thereto for application of an axially upwardly directed force to displace the inner screen assembly 32 axially upward relative to the outer receptacle 34. Other means may be utilized for attachment of the pulling tool 48 to the retrieval portion 36, such as a latching profile 50 (see FIG. 5), or other means known to those skilled in the art.

Threads 46 are formed on a tubular upper sub 52 which also forms a part of the upper seal portion 38. Upper sub 52 is threadedly and sealingly attached to a tubular seal sub 54, forming an outer annular space axially therebetween, in which are disposed two seals 56. Seals 56 sealingly engage the outer receptacle 34. It is to be understood that, although seals 56 are representatively illustrated in FIG. 1A as being of molded construction, other seals, such as o-rings or packing, may be utilized without departing from the principles of the present invention.

Seal sub 54 is threadedly and sealingly attached to the screen portion 40, forming an outer annular space therebetween, in which are disposed two seals 56. These seals 56 also sealingly engage the outer receptacle 34. Note that, as representatively illustrated in FIG. 1A, the upper sub 52, seal sub 54, and seals 56 have approximately the same outer diameter as the screen portion 40. It is to be understood, however, that each of the upper sub 52, seal sub 54, and seals 56 may have an outer diameter larger than that of the screen portion 40 (see FIG. 5) without departing from the principles of the present invention.

Screen portion 40 is generally tubular shaped and is radially inwardly and coaxially disposed relative to the outer receptacle 34. An upper end portion 58 is threadedly and sealingly attached to the seal sub 54. A pipe 60 and screen 62 are coaxially welded to the upper end portion 58 and extend axially downward therefrom, the screen 62 radially outwardly overlapping the pipe 60. As representatively illustrated in FIGS. 1A–1C, the pipe 60 is of a type known to those skilled in the art as a perforated base pipe, multiple openings 64 being formed radially therethrough. The openings 64 permit fluid communication between the screen 62 and an axially extending inner flow passage 66 of the inner screen assembly 32. It is to be understood that openings 64 may be circular, as representatively illustrated in FIGS. 1A–1C, slotted, or otherwise shaped without departing from the principles of the present invention. For use as a temporary washpipe, screen 62 may be coated with an optional dissolvable coating 63, which prevents fluid flow radially through the screen until the coating is dissolved.

Figure 1B:
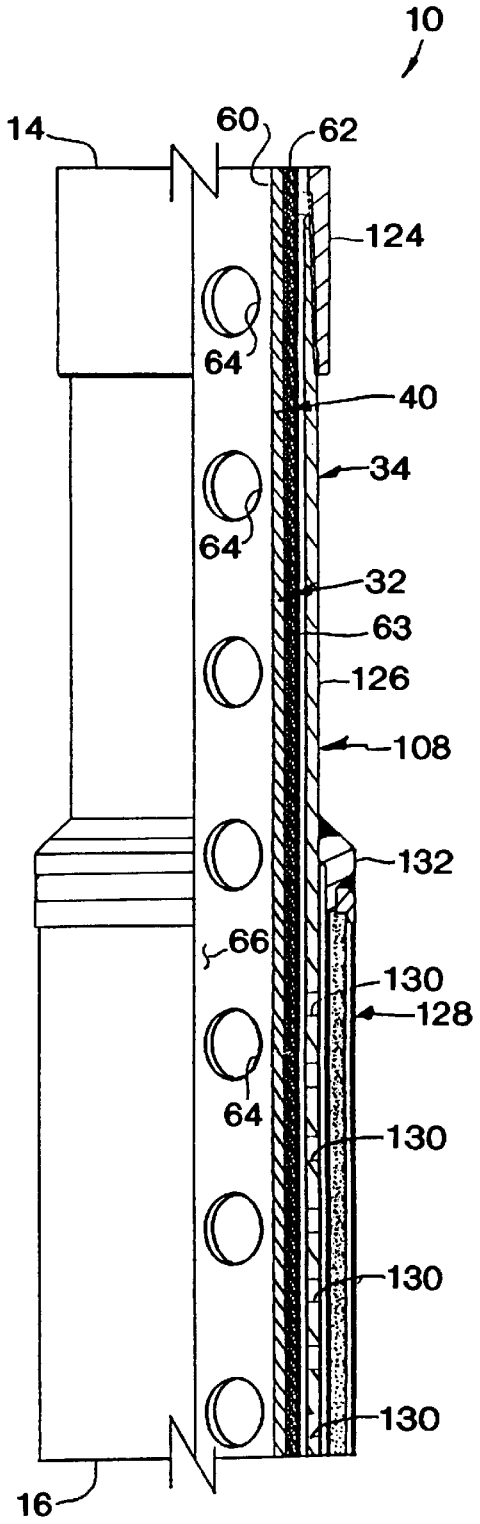
Figure 1C:
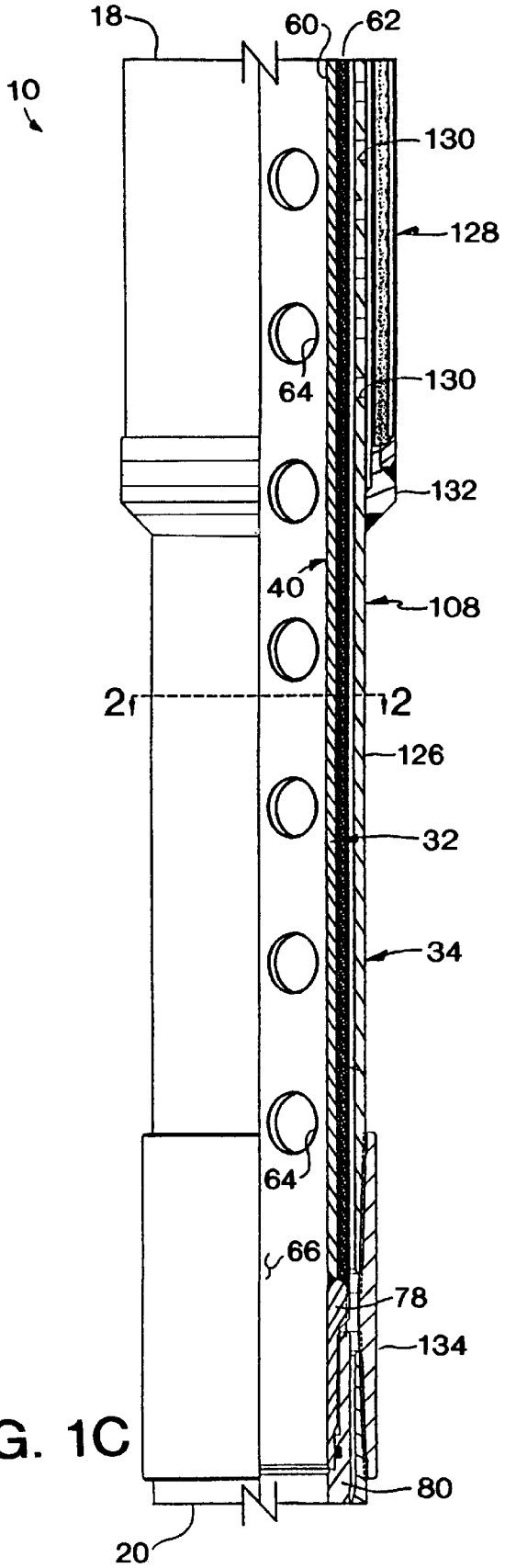
Figure 1D:
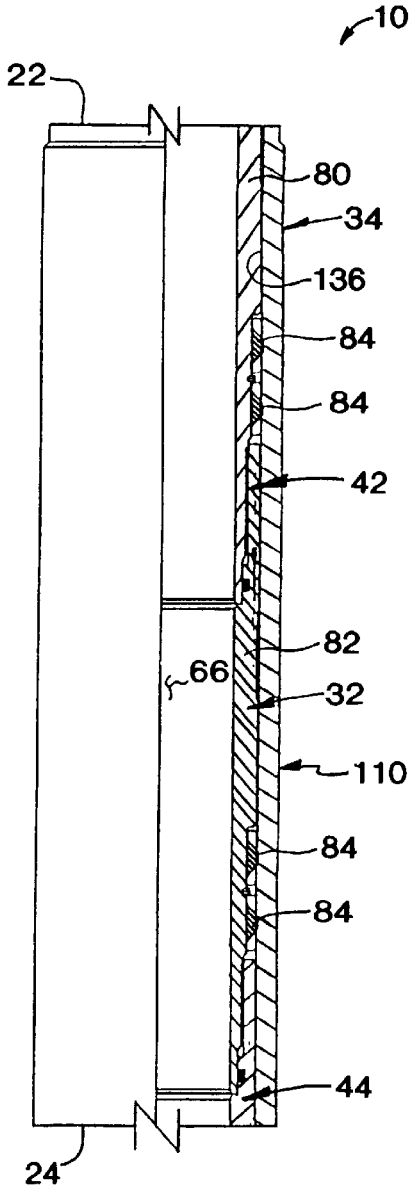
Figure 1E:
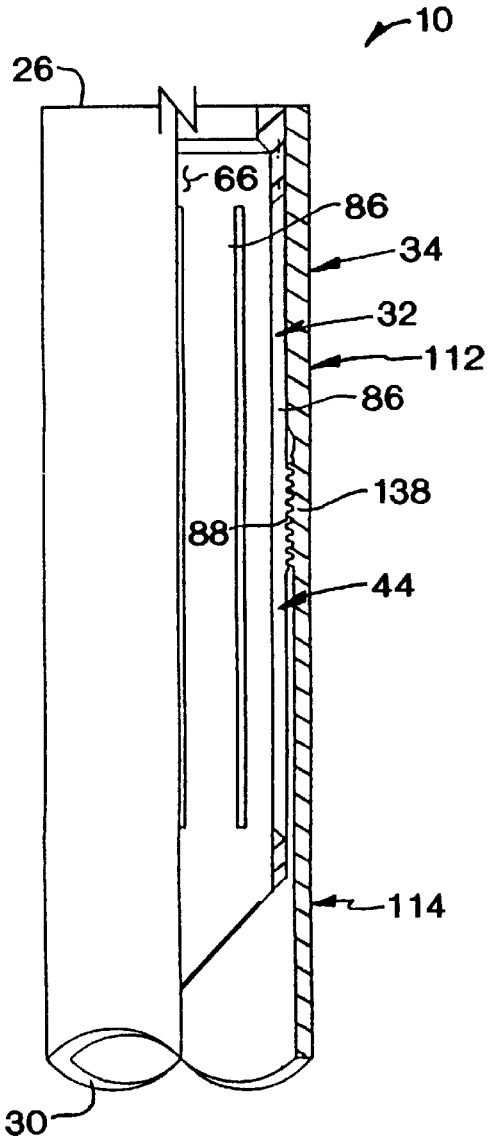

The screen 62 is representatively illustrated in FIGS. 1A–1C as being made of sintered metal, but it is to be understood that the screen may also be made of wrapped wire, ceramic material, or other materials, either singularly or in combination, without departing from the principles of the present invention. When used to provide high filtration in the inner screen assembly 32, screen 62 may only permit very small particles to pass radially therethrough. For example, screen 62 may only permit particles smaller than $40\mu$ to pass therethrough.

Figure 2:
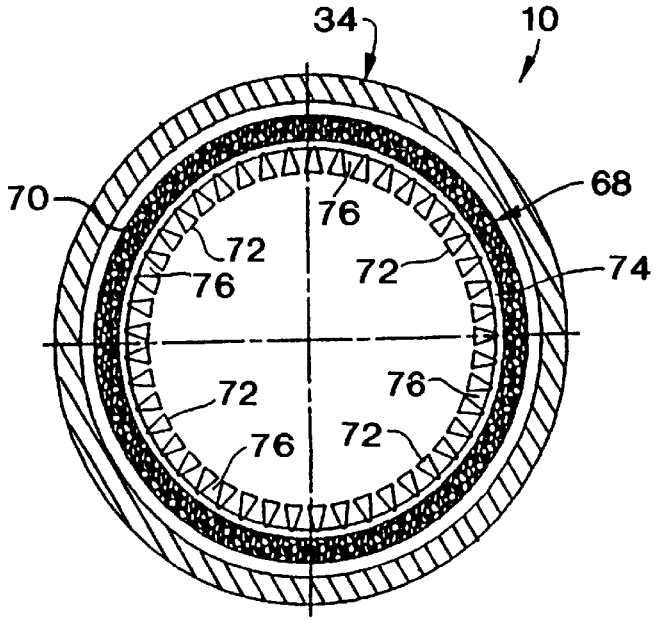
FIG. 2 is an enlarged cross-sectional view of an alternate screen portion of the retrievable screen apparatus, taken along line 2—2 of FIG. 1C.

Departing for now from the description of the retrievable screen apparatus 10 shown in FIGS. 1A–1C, an alternate construction of an inner screen assembly 68, usable in place of the inner screen assembly 32, is representatively illustrated in FIG. 2. For applications requiring relatively high filtration, the construction of inner screen assembly 68 is preferred by applicants. Inner screen assembly 68 includes a tubular sintered metal outer screen 70 and a series of axially extending and circumferentially spaced apart triangular cross-sectioned ribs 72. Spaces 76 between the ribs 72 permit fluid flow radially therethrough. Externally and spirally wrapped about the ribs 72 is wire 74. Successive spiral wraps of the wire 74 extend axially along the ribs 72. Wire 74 thus provides radially outward support for the screen 70, while permitting fluid flow radially therethrough.

Returning now to the description of the retrievable screen apparatus 10 as representatively illustrated in FIGS. 1A–1E, the screen portion 40 of the inner screen assembly 32 includes a tubular lower end portion 78. The screen 62 and pipe 60 are coaxially welded to the lower end portion 78, such that radially inwardly directed fluid flow must pass axially intermediate the upper and lower end portions 58 and 78 in order to pass radially through the screen 62 and into the inner flow passage 66.

Lower end portion 78 is threadedly and sealingly attached to a tubular seal sub 80, thereby connecting the screen portion 40 to the lower seal portion 42. Seal sub 80 is threadedly and sealingly attached to a tubular seal sub 82, forming an outer annular space axially therebetween in which are disposed two seals 84. As with the previously-described seals 56, seals 84 may be molded, as representatively illustrated in FIG. 1D, and they may be packing, o-rings, or otherwise configured without departing from the principles of the present invention. Seals 84 sealingly engage the outer receptacle 34.

Seal sub 82 is threadedly and sealingly attached to the latch portion 44, forming an outer annular space therebetween in which are disposed two seals 84. Seals 84 also sealingly engage the outer receptacle 34. It is to be understood that, although seal subs 80 and 82, and seals 84 are representatively illustrated in FIGS. 1C and 1D as having outer diameters approximately equal to an outer diameter of the screen portion 40, seal subs 80 and 82, and seals 84 may have outer diameters less than that of the screen portion 40 without departing from the principles of the present invention.

Latch portion 44 releasably secures the inner screen assembly 32 against axial movement relative to the outer receptacle 34. In the retrievable screen apparatus 10 representatively illustrated in FIG. 1E, the generally tubular latch portion 44 includes a series of axially extending and circumferentially spaced apart collets 86, two of which are visible in FIG. 1E. Collets 86 are radially inwardly compressible and have threads 88 formed externally thereon. It is to be understood that latch portion 44 may utilize other means of releasably securing the inner screen assembly 32 against axial movement relative to the outer receptacle 34 without departing from the principles of the present invention.

Departing now from the description of the retrievable screen apparatus 10 as representatively illustrated in FIGS. 1A–1E, FIG. 3 shows an alternate latch portion 90 which may be utilized in the retrievable screen apparatus. Latch portion 90 includes axially extending and circumferentially spaced apart collets 92. Each of the collets 92 has a radially enlarged portion 94 formed externally thereon which engages a complementarily shaped annular recess 96 formed externally on the outer receptacle 34. Collets 92 are radially outwardly supported by a release sleeve 98.

The release sleeve 98 is releasably secured against axial displacement relative to the outer receptacle 34 by shear screw 102 threadedly installed radially through the outer receptacle and into the release sleeve. The release sleeve 98 has a latch profile 100 internally formed thereon for application of an axially downwardly directed force to shear shear screw 102, axially downwardly displace the release sleeve, and thereby permit radially inward displacement of the collets 92. When collets 92 are no longer radially outwardly supported by the release sleeve 98, the inner screen assembly 32 may be axially displaced relative to the outer receptacle 34 by radially inwardly deflecting the collets.

Returning now to the description of the retrievable screen apparatus 10 as representatively illustrated in FIGS. 1A–1E, the inner screen assembly 32 may be installed in the outer receptacle 34 before the retrievable screen apparatus is run into a well by releasably and threadedly securing the latch portion 44 within the outer receptacle 34. Thereafter, when it is desired to retrieve the inner screen assembly 32, an axially upwardly directed force applied to the retrieval portion 36, as described hereinabove, will cause the collets 86 to radially inwardly displace, releasing the inner screen assembly for axial displacement relative to the outer receptacle 34.

Alternatively, the inner screen assembly 32 may be installed within the outer receptacle 34 after the outer receptacle has been operatively positioned in the well utilizing a variety of methods. For example, the inner screen assembly 32 may be run into the well attached to production tubing and/or pulling tool 48 (see FIGS. 4 and 6) or other equipment, inserted coaxially into the outer receptacle, and rotated within the outer receptacle to thereby engage threads 88 with the outer receptacle. As another example, if alternate latch portion 90 is utilized in inner screen assembly 32 without the release sleeve 98 (see FIG. 6), the inner screen assembly may be installed in the outer receptacle 34 by inserting the inner screen assembly coaxially within the outer receptacle and forcing the inner screen assembly axially downward relative to the outer receptacle to thereby radially inwardly compress the collets 92 until they radially outwardly engage the recess 96. Such axially downwardly directed force may be applied by tubing weight, hydraulic pressure, or other means.

The outer receptacle 34 includes an upper adaptor 104, an upper seal housing 106, a flow passage portion 108, a lower seal housing 110, an outer latch portion 112, and a lower end portion 114. Although the foregoing portions of the outer receptacle 34 are representatively illustrated as being successive axial portions, it will be readily apparent to one of ordinary skill in the art that certain ones of the portions may be interchanged or combined. For example, the outer latch portion 112 may easily be combined with the upper adaptor 104.

The upper adaptor 104 is generally tubular shaped and has the previously described upper end 28 formed thereon. Thus, the upper adaptor 104 permits attachment of the outer receptacle 34 to various items of equipment to, for example, position the outer receptacle 34 operatively within a subterranean well. The upper adaptor 104 may also have shoulders and landing surfaces, etc., formed internally or externally thereon, such as internal shoulder 116 (see FIG. 6) for supporting the inner screen assembly 32 when it is run into the well suspended from tubing, or internal landing surface 118 (see FIG. 5) for supporting the inner screen assembly 32. Upper adaptor 104 also includes an axially extending internal bore 120 for slidably receiving the upper sub 52 therein.

The upper seal housing 106 is generally tubular shaped and extends axially downward from the upper adaptor 104. As representatively illustrated in FIG. 1A, the upper seal housing 106 and the upper adaptor 104 may be integrally formed, or they may, for example, be separately formed and threadedly and sealingly attached to each other. The upper seal housing 106 has a polished axially extending seal bore 122 internally formed thereon for slidingly and sealingly receiving the upper seal portion 38 therein.

The tubular flow passage portion 108 extends axially downward from the upper seal housing 106 and is threadedly and sealingly attached thereto by means of a tubular coupling 124. The flow passage portion 108 permits radially directed fluid flow through the outer receptacle 34. As representatively illustrated in FIGS. 1B and 1C, the flow passage portion 108 includes a tubular base pipe 126 and a tubular screen 128. It is to be understood, however, that the flow passage portion 108 may be utilized without the screen 128 (see FIGS. 4 and 5), for example, when it is desired to flow fluids such as acid, resin, proppant, or gravel outwardly through the base pipe 126 and the inner screen assembly 32 is not received in the outer receptacle 34.

The base pipe 126 has multiple openings 130 formed radially therethrough. When the screen 128 is utilized in the flow passage portion 108, the openings 130 are overlapped by the screen, such that fluid flow through the openings must also pass through the screen. Openings 130 may have any of a variety of shapes, including circular, elliptical, slotted, etc., without departing from the principles of the present invention. Applicants prefer openings 130 to have shapes designed for maximum strength of the base pipe 126 in its preferred application, such as the illustrated axially extending slotted shapes. Note that alternate constructions of the base pipe 126 may be utilized without departing from the principles of the present invention, for example, axially extending ribs such as ribs 72 of the previously described alternate construction inner screen assembly 68 (see FIG. 2).

The screen 128, as representatively illustrated in FIGS. 1B and 1C, radially outwardly circumscribes the base pipe 126 and outwardly overlaps the openings 130. When utilized, the screen 128 may be otherwise disposed on the flow passage portion 108, for example, radially inwardly overlapping the openings 130, in which case the screen 128 would be radially intermediate the base pipe 126 and the inner screen assembly 32. As representatively illustrated in FIGS. 1B and 1C, screen 128 is welded to the base pipe 126 at end portions 132, which axially straddle the openings 130.

Screen 128 may be made of sintered metal, wrapped wire, ceramic material, or other materials, and combinations thereof, without departing from the principles of the present invention. When the screen 62 of the inner screen assembly 32 is utilized for relatively high filtration of fluids, applicants prefer that screen 128 of the outer receptacle 34 have somewhat less filtration, permitting somewhat larger particles to flow therethrough, such that the screen 128 will not become clogged by fine particles and the screen 62 will only have to filter fine particles from the fluid flow. It is to be understood, however, that screen 128 may have more filtration than screen 62, or filtration equivalent thereto, without departing from the principles of the present invention.

The tubular lower seal housing 110 extends axially downward from the flow passage portion 108 and is threadedly and sealingly attached thereto by means of a tubular coupling 134. A polished seal bore 136 is internally and coaxially formed on the lower seal housing 110 to slidingly and sealingly receive the lower seal portion 42 therein. Seals 84 sealingly engage the seal bore 136. Thus, when the inner screen assembly 32 is operatively installed within the outer receptacle 34, radially inwardly directed fluid flow which passes through the flow passage portion 108 must then flow radially inward through the screen portion 40.

The tubular outer latch portion 112 extends axially downward from the lower seal housing 110. As representatively illustrated in FIGS. 1D and 1E, the outer latch portion 112 and lower seal housing 110 may be integrally formed, or they may, for example, be separately formed and threadedly and sealingly attached to each other. Outer latch portion 112 has threads 138 internally formed thereon, threads 138 being complementarily shaped for engagement with threads 88 on the collets 86. Cooperative engagement between threads 88 and 138 releasably secures the inner screen assembly 32 against axial displacement relative to the outer receptacle 34.

Note that other means may be utilized for engagement of the outer receptacle 34 with the inner screen assembly 32 without departing from the principles of the present invention. For example, for alternate latch portion 90, shown in FIG. 3, the previously described annular recess 96 may be formed internally on the outer receptacle 34. Note, also, that the outer latch portion 112 and corresponding latch portion 44 may not be needed on the retrievable screen apparatus 10 where the inner screen assembly 32 is attached to tubing and is otherwise landed, latched, or connected to the outer receptacle 34 (for example, see FIG. 6), and the tubing weight, etc., operates to prevent axial displacement of the inner screen assembly relative to the outer receptacle.

The lower end portion 114 extends axially downward from the outer latch portion 112. As representatively illustrated in FIG. 1E, the lower end portion 114 and outer latch portion 112 are integrally formed, but they may, for example, be separately formed and threadedly and sealingly attached to each other. Lower end portion 114 has the previously described lower end 30 formed thereon. Thus, lower end portion 114 may operate to prevent axial fluid flow from inner flow passage 66 through lower end 30, or may permit axial fluid flow therethrough, for example, when lower end 30 is configured for attachment to other items of equipment as described hereinabove. Multiple retrievable screen apparatus 10 may be attached to one another by, for example, configuring selected ones of lower end portions 114 for attachment to corresponding and complementarily configured selected ones of upper end portions 104 (see FIG. 5 and accompanying description).

Figure 4:
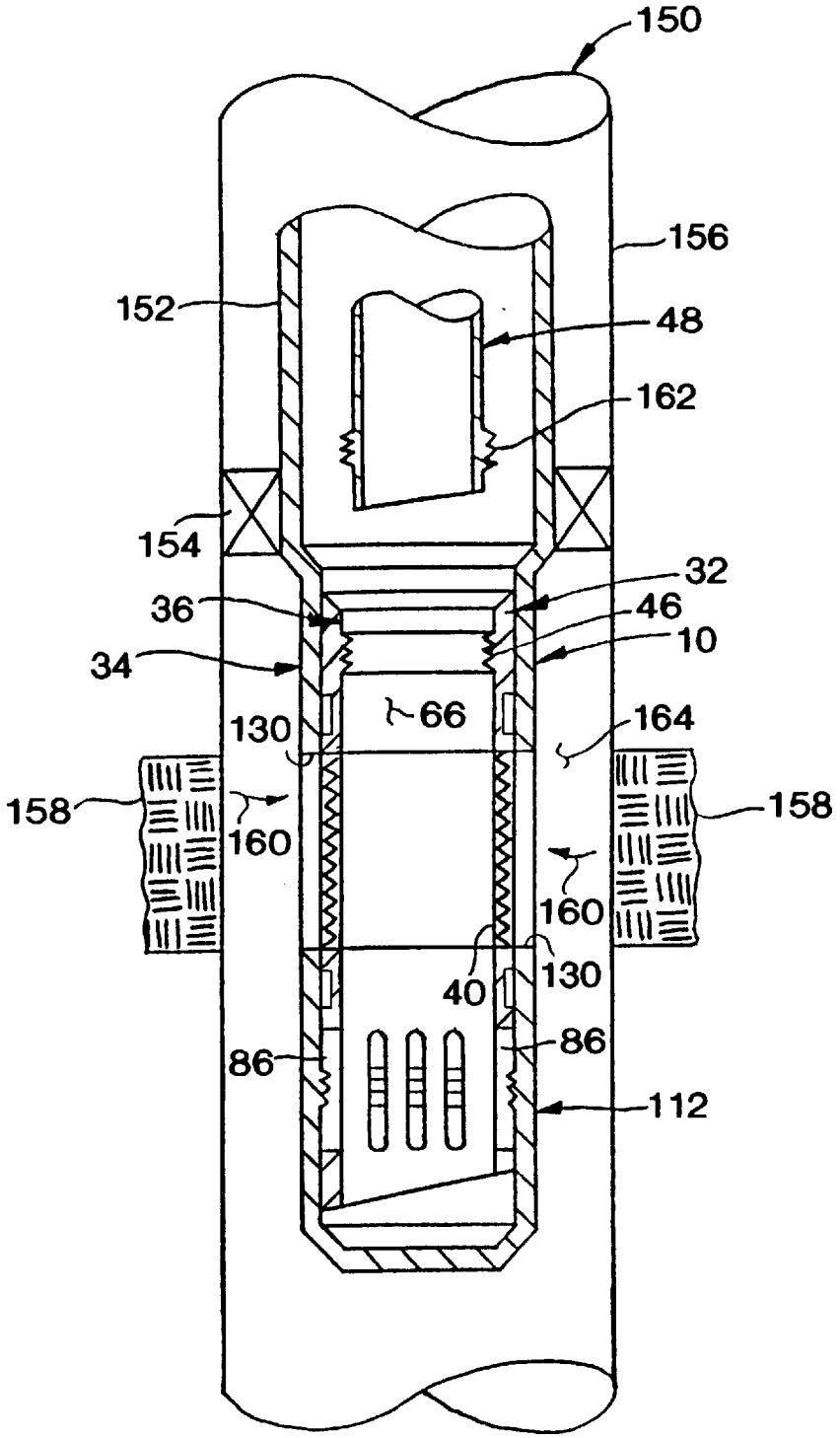
FIG. 4 is a highly schematicized cross-sectional view of the retrievable screen apparatus operatively positioned within a subterranean well, the retrievable screen apparatus being suspended from tubing received in a packer set in the well.

Referring additionally now to FIG. 4, a highly schematicized view of the retrievable screen apparatus 10 is shown operatively positioned within a subterranean well 150. The outer receptacle 34 is shown attached to tubing 152 which extends to the earth's surface. Tubing 152 is shown inserted into a packer 154 which has been set in casing 156 lining the well 150.

The retrievable screen apparatus 10 is positioned axially opposite a formation 158 intersected by the well 150. In typical practice, the casing 156 is perforated adjacent the formation 158 to permit fluids (indicated by arrows 160) within the formation to flow into the well 150. When configured as shown in FIG. 4, the retrievable screen apparatus 10 permits the fluids 160 to flow radially inward through openings 130 on the outer receptacle 34, radially inward through the screen portion 40 on the inner screen assembly 32, and into the inner flow passage 66. The fluids may then be transported to the earth's surface through the tubing 152.

The inner screen assembly 32 may be retrieved from the well 150 for cleaning or replacement by engaging a complementarily shaped pulling tool 48 with the retrieval portion 36. The pulling tool 48 may be transported into the well 150 by various means, including coiled tubing, wireline, slickline, or other means. Where the retrieval portion 36 has internally formed threads 46, and the pulling tool 48 has complementarily shaped external threads 162 formed thereon, as representatively illustrated in FIG. 4, the pulling tool is preferably rotatably manipulable in the well 150 so that the threads 46 and 162 may be operatively engaged. It is to be understood that other configurations of the pulling tool 48 may be utilized without departing from the principles of the present invention. For example, where the retrieval portion 36 has an internal latch profile 50 formed thereon (see FIG. 5), the pulling tool 48 may have a corresponding complementarily shaped configuration.

When the pulling tool 48 is operatively engaged with the retrieval portion 36, an upwardly directed axial force may be applied from the pulling tool to the inner screen assembly 32. When sufficient force has thus been applied, collets 86 will radially inwardly deflect to permit the inner screen assembly 32 to displace axially relative to the outer receptacle 34. The inner screen assembly 32 may then be withdrawn from the well 150 by raising the pulling tool 48 upwardly through the tubing 152 to the earth's surface. As previously described, the screen portion 40 may be cleaned and reinstalled, or it may be replaced.

It will be readily apparent to one of ordinary skill in the art that the retrievable screen apparatus 10, configured as shown in FIG. 4, may be utilized in operations such as fracturing, gravel packing, acidizing, injecting, etc., where fluids or slurries are forced down the tubing 152 and radially outward into the formation 158. For example, the retrievable screen apparatus 10 may be run into the well 150 without the inner screen assembly 32 being installed therein, or if previously installed, it may be retrieved before the operation is commenced. Fluids, such as acids, gels, resins, water, etc., may then be forced down the tubing 152, radially outward through openings 130, through an annular space 164 radially intermediate the outer receptacle 34 and the casing 156, and then into the formation 158. Slurries, such as gravel or proppant slurries may be forced down the tubing 152, radially outward through an item of equipment known to those skilled in the art as a crossover (not shown) installed axially intermediate the packer 154 and the outer receptacle 34, through the annular space 164, and then into the formation 158. When a gravel or proppant slurry is to be flowed into the annular space 164, openings 130 may be sized to prevent gravel or proppant flow radially inwardly therethrough, such that the gravel or proppant may accumulate in the annular space, or the screen 128 may be installed radially outwardly overlapping the openings.

When the desired operation is completed, the inner screen assembly 32 may be installed in the outer receptacle 34 by dropping it down the tubing 152, pumping it down the tubing, conveying it down the tubing attached to the pulling tool 48, or by other methods. Once the inner screen assembly 32 is inserted into the outer receptacle 34, sufficient axially downwardly directed force may then be applied to the inner screen assembly to cause collets 86 to deflect radially inward to engage the complementarily shaped outer latch portion 112, and thereby releasably secure the inner screen assembly against axial displacement relative to the outer receptacle. Such force may result from the weight of the inner screen assembly 32, pressure applied to pump the inner screen assembly through the tubing 152, a jarring force applied to the pulling tool 48, or any other method of producing an axially downwardly directed force on the inner screen assembly.

Figure 5:
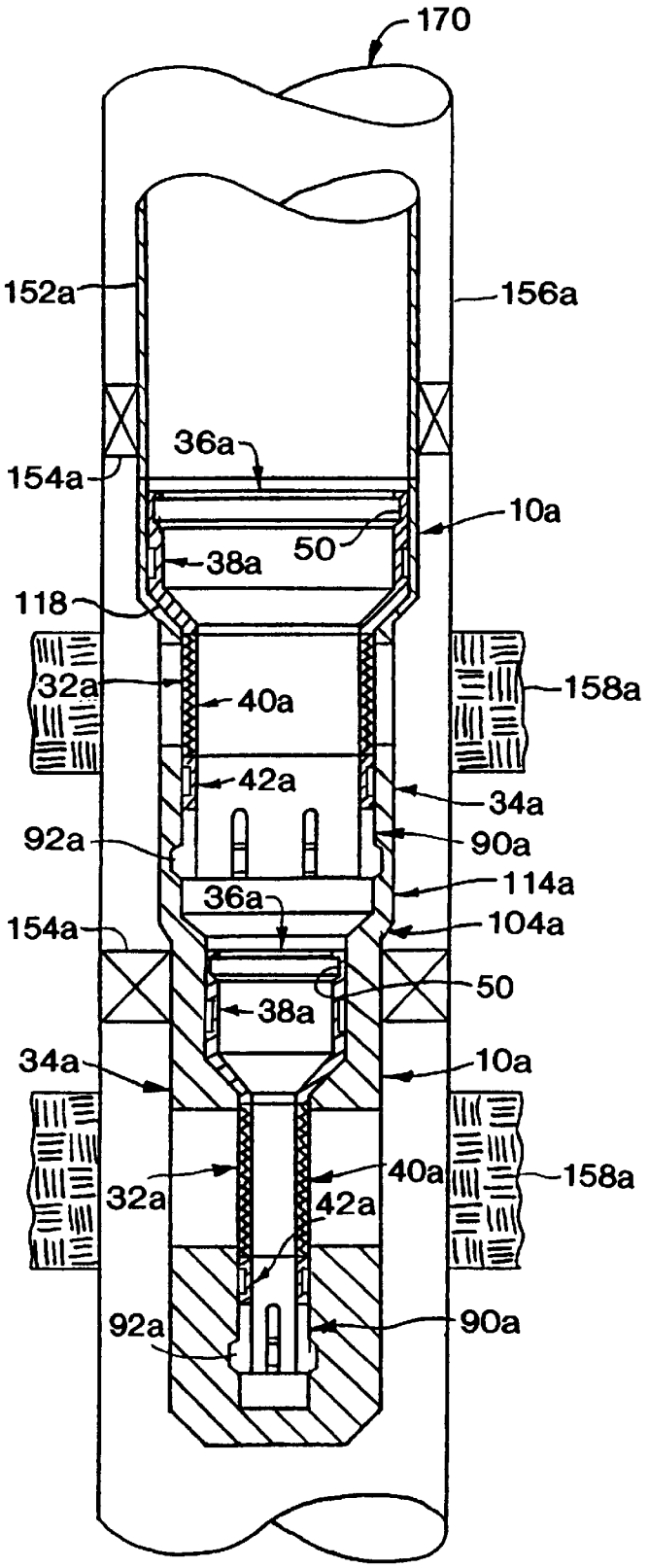
FIG. 5 is a highly schematicized cross-sectional view of an alternate construction of the retrievable screen apparatus operatively positioned within a subterranean well, the alternate construction permitting retrieval of a selected one of multiple inner screen assemblies of the retrievable screen apparatus.

Referring additionally now to FIG. 5, multiple retrievable screen apparatus 10*a* are shown operatively installed in a subterranean well 170. In FIG. 5, and the accompanying description below, elements similar to those previously described are indicated with the same reference numerals previously used, with an added suffix "a".

An upper one of the retrievable screen apparatus 10*a* is attached to tubing 152*a* extending to the earth's surface. A lower one of the retrievable screen apparatus 10*a* is attached to the upper one, such that it extends axially downward therefrom. Such attachment of retrievable screen apparatus 10*a* may be accomplished by appropriate configuration of the lower end portion 114*a* of the upper one of the retrievable screen apparatus and the upper adaptor 104*a* of the lower one of the retrievable screen apparatus, as described hereinabove.

Outer receptacles 34*a* are operatively positioned axially opposite formations 158*a*. The outer receptacle 34*a* of the lower one of the retrievable screen apparatus 10*a* is received in a lower one of two packers 154*a* set in the casing 156*a*. The tubing 152*a* is received in an upper one of the packers 154*a*. It is to be understood that other methods of engaging the retrievable screen apparatus 10*a* with the packers 154*a* may be utilized without departing from the principles of the present invention. For example, further tubing may be installed axially intermediate the lower end portion 114*a* of the upper one of the retrievable screen apparatus 10*a* and the upper adaptor 104*a* of the lower one of the retrievable screen apparatus, and such further tubing may be received in the lower one of the packers 154*a*.

Note that, as representatively illustrated in FIG. 5, the lower one of the inner screen assemblies 32*a* is smaller in diameter than the upper one of the inner screen assemblies. Thus, either of the inner screen assemblies 32*a* may be retrieved independently of the other one of them. Note also, that the retrieval portion 36*a* it and upper seal portion 38*a* of each inner screen assembly 32*a* is larger in diameter than the corresponding screen portion 40*a*, lower seal portion 42*a*, and latch portion 90*a*.

Figure 3:
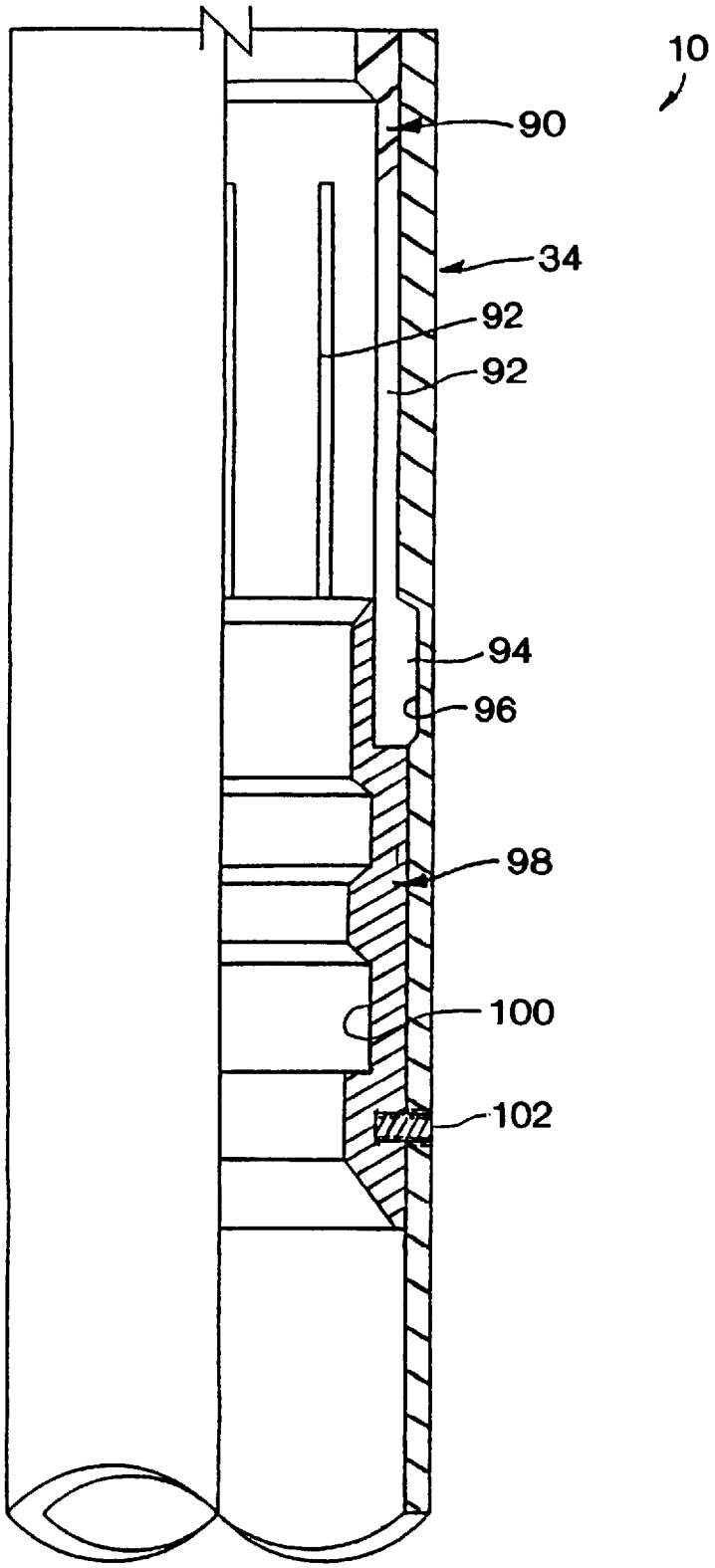
FIG. 3 is an enlarged quarter-sectional view of an alternate latch portion of the retrievable screen apparatus.

As representatively illustrated in FIG. 5, the latch portions 90*a* are configured similar to the alternate latch portion 90 representatively illustrated in FIG. 3, except that the release sleeve 98 and shear screw 102 are not utilized. Thus, inner screen assemblies 32*a* may be retrieved from retrievable screen apparatus 10*a* without the necessity of first axially displacing release sleeves.

The combination of features of the present invention representatively illustrated in FIG. 5 are shown to demonstrate a range of available options provided by the present invention. It is to be understood that applicants do not prefer that latch portions 90*a*, as representatively illustrated in FIG. 5, be utilized when upper seal portions 38*a* are larger in diameter than lower seal portions 42*a*, as pressure acting from external to internal of the inner screen assemblies 32*a* may operate to produce an axially upwardly directed force on the inner screen assemblies, which may be sufficient to cause collets 92*a* to radially inwardly deflect, permitting the inner screen assemblies to displace relative to the outer receptacles 34*a*.

Figure 6:
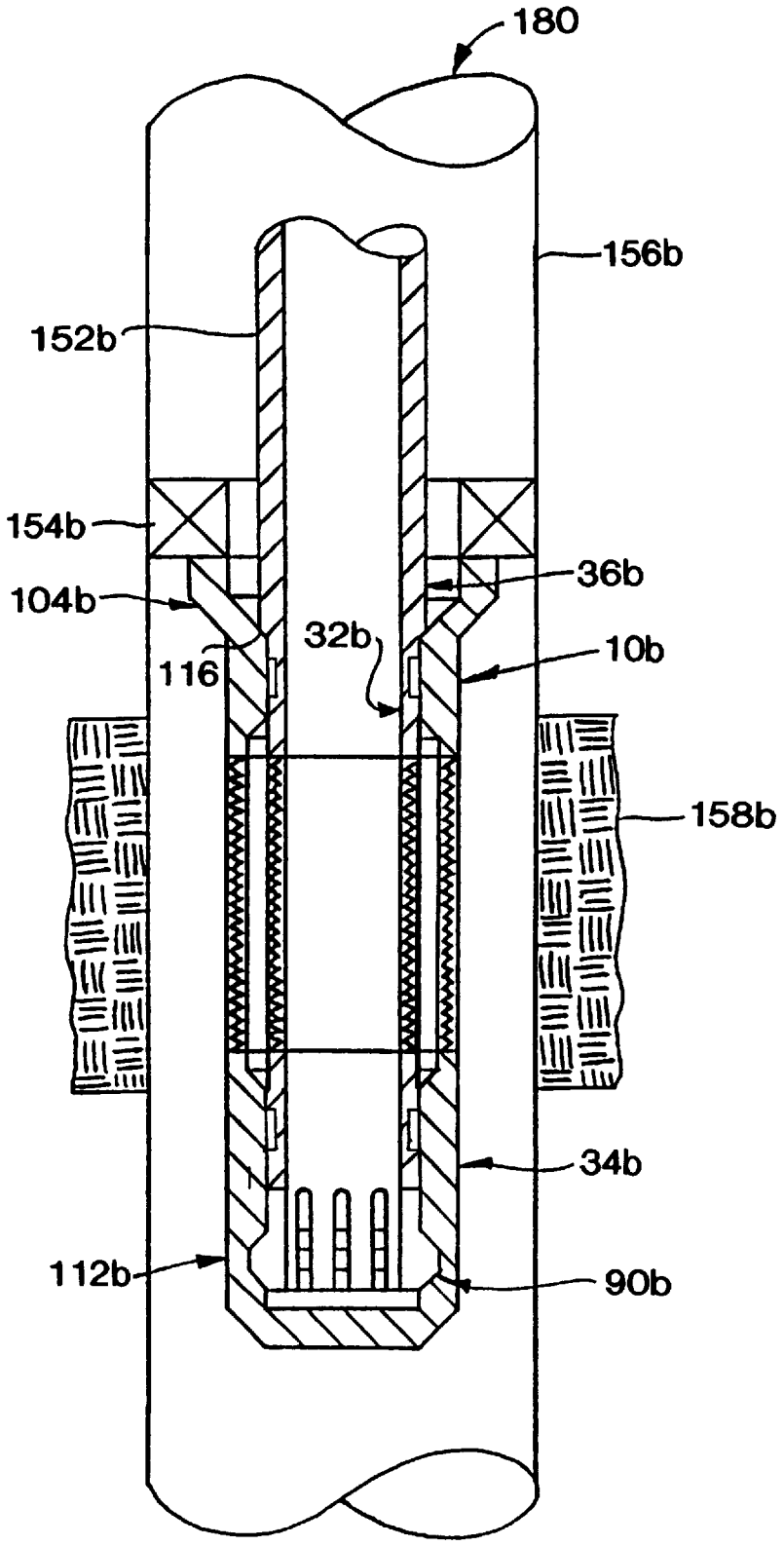
FIG. 6 is a highly schematicized cross-sectional view of an alternate construction of the retrievable screen apparatus operatively positioned within a subterranean well, an outer receptacle portion of the retrievable screen apparatus being suspended from a packer set in the well, and an inner screen assembly of the retrievable screen apparatus being suspended from tubing received in the packer.

Referring additionally now to FIG. 6, a retrievable screen apparatus 10*b* is shown operatively positioned within a subterranean well 180. In FIG. 6, and the accompanying description below, elements similar to those previously described are indicated by the same reference numerals as previously used, with an added suffix "b".

The retrievable screen apparatus 10*b* is positioned axially opposite the formation 158*b* intersected by the well 180. The outer receptacle 34*b* extends axially downward from, and is attached to, the packer 154*b*, which is set in the casing 156*b* above the formation 158*b*. The inner screen assembly 32*b* extends axially downward from, and is attached to, the tubing 152*b*. Thus, the inner screen assembly 32*b* may be retrieved from the well 180 by applying an axially upwardly directed force to the tubing 152*b* to withdraw the tubing from the well.

As representatively illustrated in FIG. 6, latch portion 90*b* does not include a release sleeve, as previously described for latch portion 90*a* shown in FIG. 5. However, the inner screen assembly 32*b* may be prevented from axially displacing relative to the outer receptacle 34*b* by the tubing 152*b*. Latch portion 90*b* and outer latch portion 112*b* may be eliminated from the retrievable screen apparatus 10*b*, if desired, for example, by applying all or a portion of the weight of the tubing 152*b* against the previously described shoulder 116 formed on upper adaptor 104*b* to thereby prevent axial displacement of the inner screen assembly 32*b* relative to the outer receptacle 34*b*.

It is to be understood that other items of equipment may be utilized in combination with the illustrated retrievable screen apparatus 10*b* without departing from the principles of the present invention. For example, an item of equipment known to those skilled in the art as a tubing release (not shown) may be installed axially intermediate the tubing 152*b* and the retrieval portion 36*b* of the inner screen assembly 32*b* so that the tubing may be withdrawn from the well 180 without also retrieving the inner screen assembly.

The foregoing detailed description is to be clearly understood as being given by way of illustration and example only, the spirit and scope of the present invention being limited solely by the appended claims.

What is claimed is:

1. A method of screening fluid flowing between an earth formation and a first length of tubing supported axially within a subterranean well and attached to a packer set in the well, the method comprising the steps of:

providing a tubular housing having an opening formed through a sidewall portion thereof;

sealingly attaching a first screen to the housing straddling the opening;

slidably disposing a second screen in the housing;

sealingly and slidingly engaging the second screen within the housing, such that the second screen is sealingly engaged with the housing straddling the opening;

sealingly attaching the housing to the first length of tubing so that the housing is supported within the well;

flowing fluid through the first and second screens;

attaching said second screen to a second length of tubing, said second length of tubing extending to the earth's surface; and removing said second screen from within said housing by pulling on said second length of tubing.

2. A method of screening fluid flowing between an earth formation and a tubular string supported axially within a subterranean well, the method comprising the steps of:

providing a tubular housing having an opening formed through a sidewall portion thereof;

sealingly attaching a first screen to the housing straddling the opening;

sealingly attaching the housing to the tubular string so that the housing is supported within the well;

coating a second screen with a dissolvable material, thereby temporarily preventing fluid flow through said second screen;

slidably disposing the second screen in the housing;

dissolving said coating to permit fluid flow through said second screen;

sealingly and slidingly engaging the second screen within the housing, such that the second screen is sealingly engaged with the housing straddling the opening; and flowing fluid through the first and second screens.

3. A method of screening fluid flowing between an earth formation and a tubular string supported axially within a subterranean well, the method comprising the steps of:

providing a tubular housing having an opening formed through a sidewall portion thereof;

sealingly attaching a first screen to the housing straddling the opening;

slidably disposing a second screen in the housing, said second screen being provided, such that said second screen filters smaller particles from flowing fluid than said first screen;

sealingly and slidingly engaging the second screen within the housing, such that the second screen is sealingly engaged with the housing straddling the opening;

sealingly attaching the housing to the tubular string so that the housing is supported within the well; and flowing fluid through the first and second screens.

4. A method of positioning fluid filtering devices within a subterranean wellbore, the method comprising the steps of:

sealingly disposing a first screen in an overlying relationship with a first opening formed through a sidewall of a tubular structure, such that fluid flowing through said first opening must also pass through said first screen;

sealingly disposing a second screen within said tubular structure, such that fluid flow through said first opening must also pass through said second screen;

sealingly disposing a third screen in an overlying relationship with a second opening formed through the tubular structure, such that fluid flowing through said second opening must also pass through said third screen;

sealingly disposing a fourth screen within said tubular structure, such that fluid flow through said second opening must also pass through said fourth screen; and disposing said tubular structure within the wellbore.

5. A method of screening fluid flowing between an earth formation and the earth's surface in a subterranean well, the method comprising the steps of:

attaching a first screen in a first tubular string;

securing the first tubular string within the well, so that the first screen filters the fluid;

attaching a second screen in a second tubular string;

inserting the second tubular string within the first tubular string, so that the second screen filters the fluid flowing through the first screen, with the second tubular string extending to the earth's surface.

6. A method of screening fluid flowing between an earth formation and the earth's surface in a subterranean well, the method comprising the steps of:

attaching a first screen in a tubular string;

securing the tubular string within the well, so that the first screen filters the fluid;

providing a second screen having a material applied thereto, the material temporarily preventing fluid flow through the screen;

inserting the second screen within the tubular string;

removing the material, thereby permitting fluid flow through the second screen; and sealingly disposing the second screen within the tubular string, so that the second screen filters the fluid flowing through the first screen.

7. A method of screening fluid flowing between an earth formation and the earth's surface, the method comprising the steps of:

attaching a first screen in a tubular string;

securing the tubular string within the well, so that the first screen filters the fluid;

releasably and sealingly disposing a second screen within the tubular string, the second screen filtering the fluid flowing through the first screen, and the second screen filtering smaller particles from the fluid than the first screen.

8. A method of screening fluid flowing between an earth formation and the earth's surface, the method comprising the steps of:

attaching first and second spaced apart screens in a tubular string;

sealingly disposing third and fourth screens within the tubular string; and positioning the tubular string within the well, the third screen filtering fluid flowing through the first screen, and the fourth screen filtering fluid flowing through the second screen.

9. The method according to claim 8, wherein the sealingly disposing step further comprises disposing the third screen within the tubular string between the earth's surface and the fourth screen at a minimum inner dimension of the tubular string greater than a maximum outer dimension of the fourth screen, so that the fourth screen is retrievable to the earth's surface through the tubular string.

* * * * *